US011125448B2

(12) United States Patent
Lee

(10) Patent No.: US 11,125,448 B2
(45) Date of Patent: Sep. 21, 2021

(54) DESICCANT COOLING SYSTEM

(71) Applicant: KOREA INSTITUTE OF SCIENCE AND TECHNOLOGY, Seoul (KR)

(72) Inventor: Dae-Young Lee, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 103 days.

(21) Appl. No.: 16/285,721

(22) Filed: Feb. 26, 2019

(65) Prior Publication Data

US 2019/0264931 A1 Aug. 29, 2019

(30) Foreign Application Priority Data

Feb. 27, 2018 (KR) ..... 10-2018-0023895

(51) Int. Cl.

| | |
|---|---|
| ***F24F 3/14*** | (2006.01) |
| ***F28F 13/18*** | (2006.01) |
| ***F28F 17/00*** | (2006.01) |
| ***F28F 19/02*** | (2006.01) |

(52) U.S. Cl.

CPC ..... *F24F 3/1417* (2013.01); *F28F 13/18* (2013.01); *F28F 17/00* (2013.01); *F28F 19/02* (2013.01); *F28F 2245/04* (2013.01)

(58) Field of Classification Search

CPC ..... F24F 3/1417; F24F 13/18

See application file for complete search history.

(56) References Cited

U.S. PATENT DOCUMENTS

| | | | | |
|---|---|---|---|---|
| 2003/0121271 | A1* | 7/2003 | Dinnage | F24F 3/1405 62/94 |
| 2010/0242507 | A1* | 9/2010 | Meckler | F25B 40/00 62/94 |
| 2011/0232310 | A1* | 9/2011 | Kawashima | F24F 13/222 62/176.1 |
| 2015/0184873 | A1* | 7/2015 | Lee | F24F 3/14 62/56 |

FOREIGN PATENT DOCUMENTS

| | | | |
|---|---|---|---|
| JP | 09-287758 | A | 11/1997 |
| JP | 5107379 | B2 | 12/2012 |
| KR | 10-2010-0035765 | A | 4/2010 |
| KR | 10-1416652 | B1 | 7/2014 |
| WO | WO 2016/144138 | A1 | 9/2016 |

OTHER PUBLICATIONS

Korean Office Action dated Mar. 28, 2019.

* cited by examiner

*Primary Examiner* — Elizabeth J Martin

(74) *Attorney, Agent, or Firm* — Rabin & Berdo, P.C.

(57) ABSTRACT

A desiccant cooling system includes a desiccant module mounted in a division plate to be rotatable and having a side mounted in a desiccant cooling path through which indoor air moves and another side mounted in a regeneration path through which outdoor air moves, a preliminary cooler mounted at an upstream of the desiccant module in the desiccant cooling path and configured to cool the indoor air flowing into the desiccant cooling path; and a main cooler mounted at a downstream of the desiccant module in the desiccant cooling path, and configured to cool the indoor air dehumidified by passing through the desiccant module and supply the cooled indoor air to an air-conditioning space, wherein a dew-point temperature of the indoor air dehumidified by passing through the side of the desiccant module is less than a temperature of the main cooler.

3 Claims, 4 Drawing Sheets

DESICCANT COOLING SYSTEM

CROSS-REFERENCE TO RELATED APPLICATION

This application claims the benefit of Korean Patent Application No. 10-2018-0023895, filed on Feb. 27, 2018, in the Korean Intellectual Property Office, the disclosure of which is incorporated herein in its entirety by reference.

BACKGROUND

1. Field

One or more embodiments relate to a desiccant cooling system, and more particularly, to a desiccant cooling system configured to prevent the occurrence of condensate water.

2. Description of the Related Art

Generally, a heat exchanger includes a compressor, a condenser, an expansion valve, and an evaporator, through which a refrigerant flows and which are arranged in series. A cooling operation is performed by the evaporator. The evaporator performs cooling and dehumidification operations on air passing through the evaporator. Condensate water is generated during these operations. The condensate water is formed in a cooling fin or tube of the evaporator, thereby generating an environment favorable to formation of fungi, which may generate bad smell of air emitted by an air-conditioner and indoor air contamination.

Korean Patent Registration No. 10-1416652 describes a heat exchanger configured to perform a superhydrophobic operation on a cooling fin of an evaporator to always maintain the cooling fin dry and suppress propagation of bacteria, viruses, and fungi at a surface of the cooling fin.

However, even if this method configured to prevent formation of condensate water in the cooling fin is used, a structure to discharge the condensate water accumulated inside the heat exchanger to the outside is additionally needed. Thus, in order to fundamentally solve the problem of bad smell caused by the occurrence of condensate water, the occurrence of condensate water in the heat exchanger needs to be prevented.

Information disclosed in this Background section was already known to the inventors before achieving the inventive concept or is technical information acquired in the process of achieving the inventive concept. Therefore, it may not be necessarily known to the public before the application of the inventive concept.

SUMMARY

One or more embodiments include a desiccant cooling system configured to prevent an occurrence of condensate water.

Additional aspects will be set forth in part in the description which follows and, in part, will be apparent from the description, or may be learned by practice of the presented embodiments.

According to one or more embodiments, a desiccant cooling system includes: a desiccant module mounted in a division plate to be rotatable and having a side mounted in a desiccant cooling path through which indoor air moves and another side mounted in a regeneration path through which outdoor air moves, wherein the division plate defines the desiccant cooling path and the regeneration path; a preliminary cooler mounted at an upstream of the desiccant module in the desiccant cooling path and configured to cool the indoor air flowing into the desiccant cooling path; and a main cooler mounted at a downstream of the desiccant module in the desiccant cooling path and configured to cool the indoor air dehumidified by passing through the desiccant module and supply the cooled indoor air to an air-conditioning space, wherein a dew-point temperature of the indoor air dehumidified by passing through the side of the desiccant module is less than a temperature of the main cooler.

The desiccant cooling system may further include a condensation sensing sensor mounted in the preliminary cooler and configured to sense whether or not the indoor air is condensed and condensate water is generated in the preliminary cooler.

The desiccant cooling system may further include a preliminary cooling temperature controller configured to control a temperature of the preliminary cooler such that the temperature of the preliminary cooler is maintained to be higher than the dew-point temperature of the indoor air flowing into the desiccant cooling path, based on a signal of the condensation sensing sensor.

The desiccant cooling system may further include a heater mounted at an upstream of the desiccant module in the regeneration path and configured to heat the outdoor air flowing into the regeneration path.

As the desiccant module rotates with respect to the division plate, the desiccant module may be configured to dehumidify the indoor air so as to adsorb water vapors from the indoor air while a portion of the desiccant module is passing through the desiccant cooling path, and the desiccant module may further be configured to regenerate via the outdoor air and discharge the water vapors to the outdoor air while the portion of the desiccant module is passing through the regeneration path.

According to one or more embodiments, a desiccant cooling system includes: a desiccant module mounted in a division plate to be rotatable and having a side mounted in a desiccant cooling path through which indoor air moves and another side mounted in a regeneration path which is closed and through which regeneration air moves, wherein the division plate defines the desiccant cooling path and the regeneration path; a preliminary cooler mounted at an upstream of the desiccant module in the desiccant cooling path and configured to cool the indoor air flowing into the desiccant cooling path; and a main cooler mounted at a downstream of the desiccant module in the desiccant cooling path, and configured to cool the indoor air dehumidified by passing through the desiccant module and supply the cooled indoor air to an air-conditioning space, wherein a dew-point temperature of the indoor air dehumidified by passing through the side of the desiccant module is less than a temperature of the main cooler.

The desiccant cooling system may further include: a condensation sensing sensor mounted in the preliminary cooler and configured to sense whether or not the indoor air is condensed and condensate water is generated in the preliminary cooler.

The desiccant cooling system may further include a preliminary cooling temperature controller configured to control a temperature of the preliminary cooler such that the temperature of the preliminary cooler is maintained to be higher than the dew-point temperature of the indoor air flowing into the desiccant cooling path, based on a signal of the condensation sensing sensor.

As the desiccant module rotates with respect to the division plate, the desiccant module may be configured to dehumidify the indoor air so as to adsorb water vapors from the indoor air while a portion of the desiccant module is passing through the desiccant cooling path, and the desiccant module may further be configured to regenerate via the regeneration air and discharge the water vapors to the regeneration air while the portion of the desiccant module is passing through the regeneration path.

The desiccant cooling system may further include a heater mounted at an upstream of the desiccant module in the regeneration path and configured to heat the regeneration air.

The desiccant cooling system may further include: a cooling desiccant unit mounted at a downstream of the desiccant module and an upstream of the heater in the regeneration path, and configured to cool and dehumidify the regeneration air humidified by passing through the desiccant module, and transfer the cooled and dehumidified regeneration air to the heater.

The cooling desiccant unit may share a refrigerant heat source with the main cooler.

The desiccant cooling system may further include a condensate water storage unit configured to store condensate water generated in the cooling desiccant unit.

The desiccant module may include an antifungal agent.

The desiccant cooling system may further include a reference plate mounted in the regeneration path and forming a circulation path so that the regeneration air sequentially passes through the heater, the desiccant module, and the cooling desiccant unit, and then, flows into the heater again.

The desiccant cooling system may further include a heat recovery heat exchanger having a side cooling the regeneration air humidified by passing through the desiccant module and another side heating the regeneration air cooled and dehumidified by passing through the cooling desiccant unit.

As the heat recovery heat exchanger rotates with respect to the reference plate, the heat recovery heat exchanger may be configured to cool the regeneration air while a portion of the heat recovery heat exchanger is passing through an area at which the side cooling the regeneration air is located, and the heat recovery heat exchanger may be configured to heat the regeneration air while the portion of the heat recovery heat exchanger is passing through an area at which the other side heating the regeneration air is located.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

The present disclosure will be more clearly understood by referring to the embodiments described below in detail with accompanying drawings. The present disclosure may, however, be embodied in many different forms and should not be construed as being limited to the embodiments set forth herein; rather these embodiments are provided so that this disclosure will thorough and complete, and will fully convey the inventive concept to one of ordinary skill in the art. The present disclosure is defined by the scope of the claims.

Meanwhile, the terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that when a part and/or an operation "includes" or "comprises" an element, unless otherwise defined, the part and/or the operation may further include other elements, not excluding the other elements.

Also, the terms such as " . . . unit," "module," or the like used in the present specification indicate an unit, which processes at least one function or motion, and the unit may be implemented by hardware or software, or by a combination of hardware and software.

Figure 1:
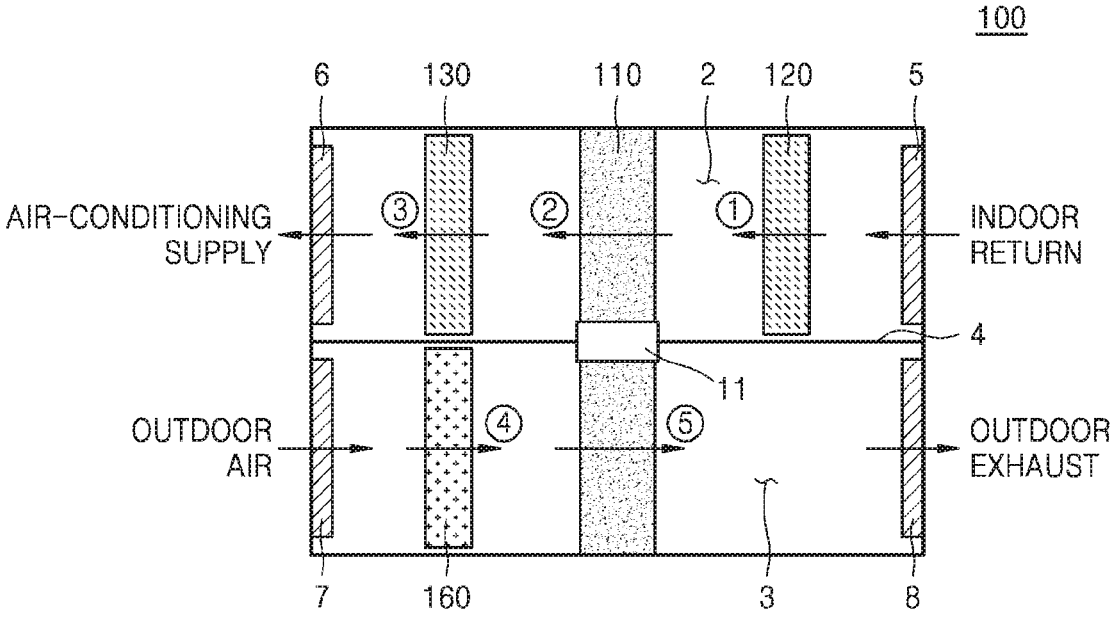
FIG. 1 is a schematic structural diagram of a desiccant cooling system according to an embodiment.

FIG. 1 is a schematic structural diagram of a desiccant cooling system 100 according to an embodiment.

The desiccant cooling system 100 according to the embodiment illustrated in FIG. 1 may have a side mounted in a desiccant cooling path 2 through which indoor air moves and another side mounted in a regeneration path 3 through which outdoor air moves, and may include a desiccant module 110, a preliminary cooler 120, and a main cooler 130. The desiccant module 110 may be mounted to be rotatable at a division plate 4 dividing the desiccant cooling path 2 and the regeneration path 3, the preliminary cooler 120 may be mounted at an upstream of the desiccant module 110 in the desiccant cooling path 2 and may cool the indoor air flowing into the desiccant cooling path 2, and the main cooler 130 may be mounted at a downstream of the desiccant module 110 in the desiccant cooling path 2, may cool the indoor air dehumidified by passing through the desiccant module 110, and may supply the cooled indoor air to an air-conditioning space (not shown).

Regarding the desiccant cooling system 100 having the structure described above, a dew-point temperature of the indoor air dehumidified by passing through the side of the desiccant module 110 may be less than a temperature of the main cooler 130. Accordingly, a dew condensation phenomenon in which water vapor in the indoor air is condensed and forms a droplet may be prevented in the main cooler 130.

The desiccant module 110 may be mounted in the desiccant cooling system 100 to be rotatable around a rotational axis 11 mounted in the division plate 4. The desiccant cooling system 100 may be divided into the desiccant cooling path 2 through which the indoor air moves and the regeneration path 3 through which the outdoor air moves, based on the division plate 4. The indoor air is dehumidified and cooled along the desiccant cooling path 2, and the desiccant module 110 is regenerated along the regeneration path 3.

In an embodiment, the desiccant module 110 may have a porous structure and may be ceramic paper having a honeycomb shape, wherein a surface of the ceramic paper is stably coated with a desiccant agent, such as silica gel. The desiccant module 110 may adsorb water vapors from the air via the desiccant agent. However, the desiccant agent may not unlimitedly adsorb water vapors from the air, and thus, the water adsorbed by the desiccant agent may have to be periodically vaporized so that the desiccant agent may be adsorb water vapors again.

The operation of vaporizing the water adsorbed by the desiccant agent is referred to as "regeneration" of the desiccant module 110. In an embodiment, water adsorbed by the desiccant agent may be vaporized, that is, the desiccant module 110 may be regenerated, by blowing high temperature air toward the desiccant module 110.

As the desiccant module 110 rotates with respect to the division plate 4, the desiccant module 110 may dehumidify the indoor air and adsorb water vapors from the indoor air while a portion of the desiccant module 110 passes through the desiccant cooling path 2, may be regenerated by the outdoor air, and may discharge the water vapors to the outdoor air while the portion of the desiccant module 110 passes through the regeneration path 3.

Thus, the desiccant module 110 illustrated in FIG. 1 may simultaneously perform, rather than time-sequentially, the dehumidifying function and the regeneration function described above. That is, assuming that a location of the desiccant module 110 illustrated in FIG. 1 is not changed in time, the indoor air may be dehumidified in an upper area of the desiccant module 110, the upper area being located in the desiccant cooling path 2, and the desiccant module 110 may be regenerated by the outdoor air in a lower area of the desiccant module 110, the lower area being located in the regeneration path 3.

According to embodiments of the present disclosure, since the desiccant module 110 may rotate with respect to the rotational axis 11, the side of the desiccant module 110, which is located in the desiccant cooling path 2, may move to the regeneration path 3 by the rotation of the desiccant module 110, and the other side of the desiccant module 110, which is located in the regeneration path 3, may move to the desiccant cooling path 2 by the rotation of the desiccant module 110. Also, as this operation continues, the desiccant module 110 may simultaneously perform the dehumidification function and the regeneration function.

As illustrated in FIG. 1, the indoor air that is dehumidified by the desiccant module 110 and then cooled by passing through the main cooler 130 is supplied as conditioned air to the air-conditioning space. Thus, if the dehumidification function of the desiccant module 110 is stopped and thus regeneration of the desiccant module 110 is also stopped, conditioned air may not be supplied to the air-conditioning space. However, according to the desiccant cooling system 100 according to embodiments of the present disclosure, the dehumidification function and the regeneration function of the desiccant module 110 may be simultaneously performed. Thus, conditioned air may not be stopped from being supplied to the air-conditioning space while the desiccant cooling system 100 is operating.

A heater 160 mounted at the upstream of the desiccant module 110 and heating the outdoor air flowing into the regeneration path 3 may be mounted in the regeneration path 3. The heater 160 may include waste heat or refrigerant condensation exhaust heat, and thus, may regenerate the desiccant module 110 without additional energy consumption.

A difference between cases in which the desiccant cooling system 100 includes and does not include the preliminary cooler 120 will be described by referring to FIGS. 2 and 3.

Figure 2:
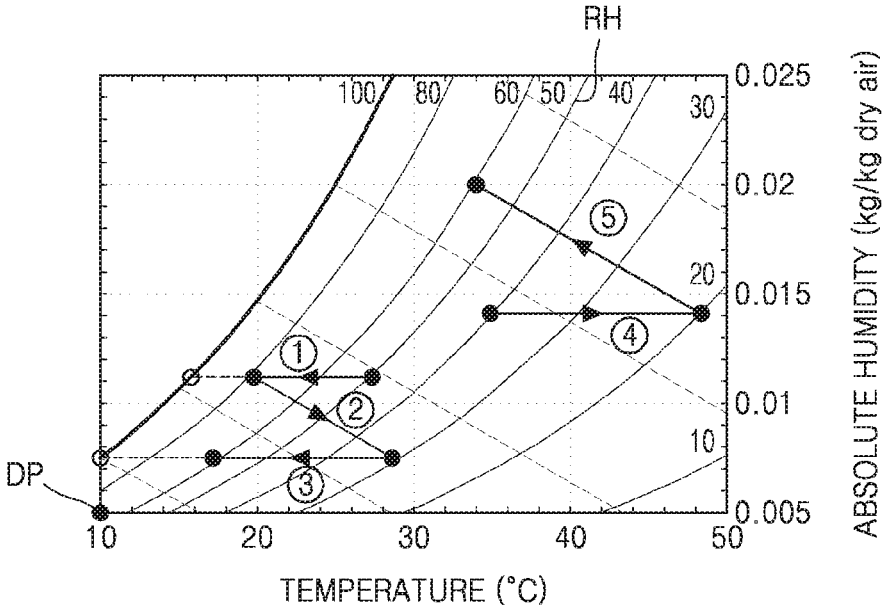
FIG. 2 is a psychrometric chart of indoor air and outdoor air moving through the desiccant cooling system illustrated in FIG. 1.
Figure 3:
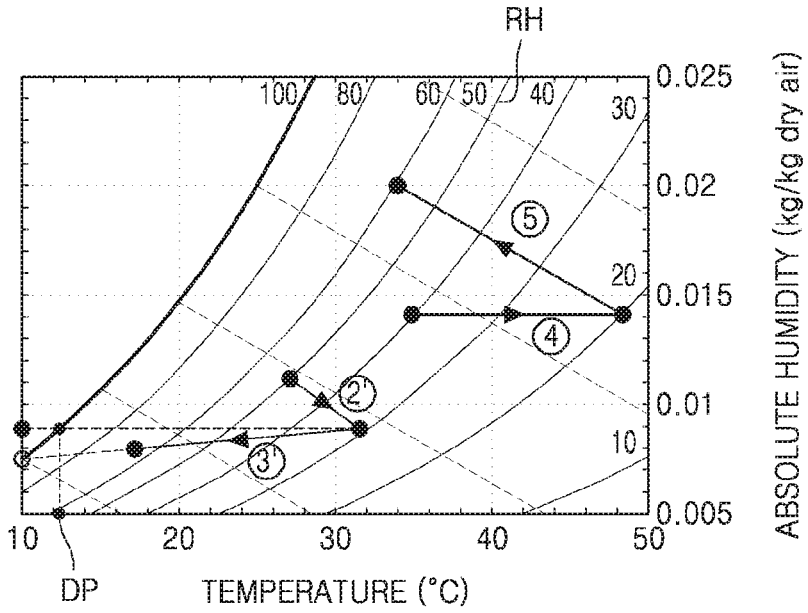
FIG. 3 is a psychrometric chart of indoor air and outdoor air moving through a desiccant cooling system excluding a preliminary cooler.

FIG. 2 is a psychrometric chart of indoor air and outdoor air moving through the desiccant cooling system 100 illustrated in FIG. 1, and FIG. 3 is a psychrometric chart of indoor air and outdoor air moving through a desiccant cooling system not including a preliminary cooler.

Referring to FIG. 2, the indoor air having flown into the desiccant cooling path 2 through an indoor air inlet 5 may be cooled (refer to ①) by passing through the preliminary cooler 120. Next, the indoor air cooled by the preliminary cooler 120 may be dehumidified and cooled (refer to ②) by passing through the desiccant module 110. Next, the indoor air dehumidified and cooled by passing through the desiccant module 110 may be cooled (refer to ③) by passing through the main cooler 130 and supplied to an air-conditioning space via an indoor air outlet 6.

That is, the indoor air having flown into the desiccant cooling path 2 may sequentially pass through the preliminary cooler 120, the desiccant module 110, and the main cooler 130 to be cooled and dehumidified, and in particular, a dew-point temperature DP of the indoor air having passed through the desiccant module 110 may be about 10 degrees Celsius (a value defined for convenience of explanation), which is a value of an X-axis of the chart illustrated in FIG. 2, at a point in which an absolute humidity (Y-axis) of the indoor air meets a saturation relative humidity chart (in the case of 100 of a RH chart for convenience of explanation).

Here, the dew-point temperature DP (10 degrees Celsius) of the indoor air having passed through the desiccant module 110 may be lower than a temperature of the main cooler 130. This is because the indoor air may be dehumidified by passing through the desiccant module 110 so that an absolute amount of water vapor in the indoor air may be decreased from about 0.011 to about 0.008.

Meanwhile, referring to FIG. 3, the indoor air having flown into the indoor air inlet 5 may directly pass through the desiccant module 110 to be dehumidified and cooled (refer to ②'), without passing through the preliminary cooler 120 illustrated in FIG. 1. In this case, the indoor air may not be sufficiently dehumidified by the desiccant module 110, and thus, a dew-point temperature DP' of the indoor air having passed through the desiccant module 110 may be about 12 degrees Celsius (a value defined for convenience of explanation), which is higher than the temperature of the main cooler 130. Accordingly, while the indoor air is cooled by passing through the main cooler 130, a dew condensation phenomenon (refer to ③') may occur so that condensate water is generated in the main cooler 130.

Thus, as illustrated in FIG. 1, when the indoor air is pre-cooled by the preliminary cooler 120 before flowing into the desiccant module 110, a desiccant effect of the desiccant module 110 is maximized so that the dew-point temperature of the indoor air flowing into the main cooler 130 becomes lower than the temperature of the main cooler 130. Thus, the dew condensation phenomenon which may occur in the main cooler 130 may be prevented.

That is, according to the desiccant cooling system 100 according to the embodiment illustrated in FIG. 1, condensate water may not occur in the main cooler 130, and thus, it may be prevented that the condensate water is formed between cooling fins of the main cooler 130 in order to generate fungi to cause bad smell, or the fungi are introduced to an indoor environment by an air-conditioning operation to contaminate the indoor environment.

Meanwhile, for the desiccant module 110 to continually serve the dehumidification and cooling functions, the desiccant module 110 has to be continually regenerated, except for a portion thereof serving the dehumidification and cooling functions, as described above.

That is, referring to FIGS. 2 and 3, the outdoor air having flown into the regeneration path 3 via an outdoor air inlet 7 may be heated (refer to ④) by passing through the heater 160 and the outdoor air heated by the heater 160 may be humidified and cooled (refer to ⑤) by passing through the desiccant module 110. This is because, as described above, since the desiccant module 110 is regenerated by the outdoor air having high temperature, water vapor in the desiccant agent of the desiccant module 110 may be vaporized, and simultaneously, due to the vaporization of the water vapor, the desiccant module 110 may be cooled, so that the outdoor air passing through the desiccant module 110 may also be cooled.

As such, the outdoor air moving through the regeneration path 3 of the desiccant cooling system 100 according to the embodiment illustrated in FIG. 1 may continually regenerate the desiccant module 110 passing through the regeneration path 3, by going through the operations ④ and ⑤.

Figure 4:
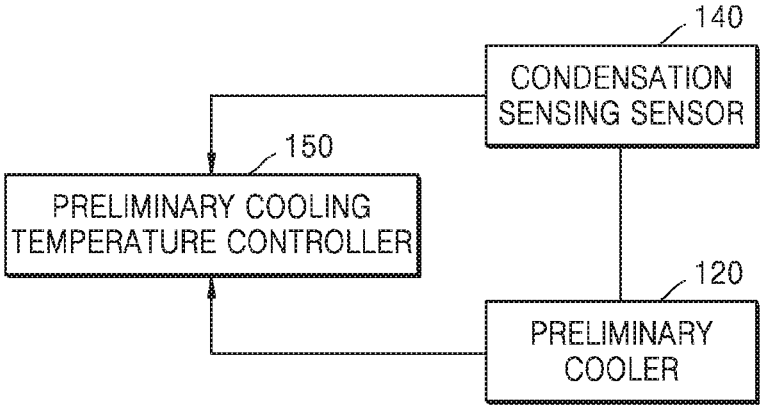
FIG. 4 is a structural diagram of some components of the desiccant cooling system illustrated in FIG. 1.

FIG. 4 is a structural diagram of some components of the desiccant cooling system 100 illustrated in FIG. 1.

Referring to FIG. 4, the desiccant cooling system 100 may further include a condensation sensing sensor 140 and a preliminary cooling temperature controller 150, wherein the condensation sensing sensor 140 may be mounted in the preliminary cooler 120 and may sense whether or not indoor air is condensed and condensate water is generated in the preliminary cooler 120, and the preliminary cooling temperature controller 150 may, based on a signal sensed by the condensation sensing sensor 140, control a temperature of the preliminary cooler 120 such that a dew-point temperature of the indoor air flowing into the desiccant cooling path 2 is maintained to be lower than the temperature of the preliminary cooler 120.

Just as dew condensation occurs when a dew-point temperature of the indoor air passing through the main cooler 130 is higher than a temperature of the main cooler 130, dew condensation may occur when a dew-point temperature of the indoor air passing through the preliminary cooler 120 is higher than the temperature of the preliminary cooler 120. Thus, it is necessary to keep the temperature of the preliminary cooler 120 higher than the dew-point temperature of the indoor air flowing into the desiccant cooling path 2.

Thus, the condensation sensing sensor 140 may continually sense whether or not condensate water occurs in the preliminary cooler 120, and the preliminary cooling temperature controller 150 may control the temperature of the preliminary cooler 120 based on a signal generated by the condensation sensing sensor 140, in order to keep the temperature of the preliminary cooler 120 to be higher than the dew-point temperature of the indoor air flowing into the desiccant cooling path 2.

For example, when the condensation sensing sensor 140 senses that the condensate water occurs in the preliminary cooler 120, the preliminary cooling temperature controller 150 may receive a signal related to this sensing from the condensation sensing sensor 140 and may, for example, reduce a flow amount of a refrigerant flowing into the preliminary cooler 120, in order to increase the temperature of the preliminary cooler 120.

Figure 5:
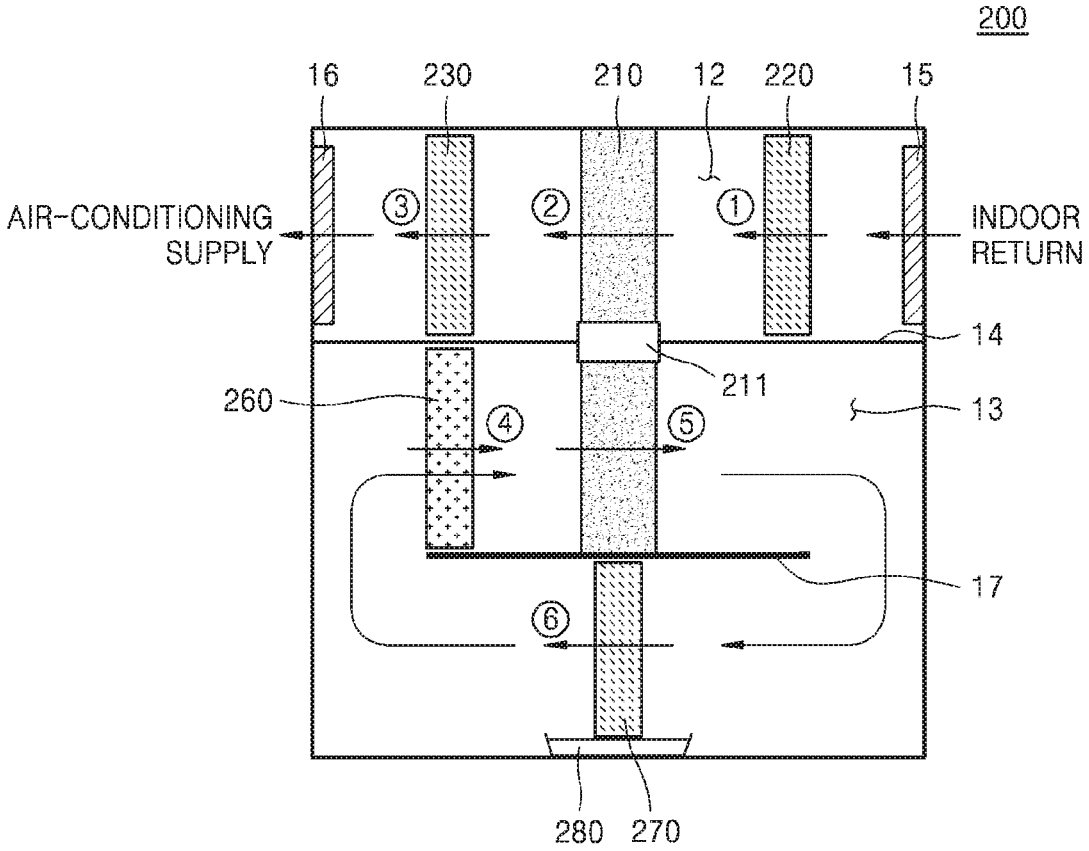
FIG. 5 is a schematic structural diagram of a desiccant cooling system according to another embodiment.

FIG. 5 is a schematic structural diagram of a desiccant cooling system 200 according to another embodiment.

The desiccant cooling system 200 according to the embodiment illustrated in FIG. 5 may have a side mounted in a desiccant cooling path 12 through which indoor air flows and the other side mounted in a regeneration path 13 which is closed and through which regeneration air flows, and may include a desiccant module 210 rotatable around a rotational axis 211, a preliminary cooler 220, and a main cooler 230, wherein the desiccant module 210 may be mounted to be rotatable at a division plate 14 dividing the desiccant cooling path 12 and the regeneration path 13, the preliminary cooler 220 may be mounted at an upstream of the desiccant module 210 in the desiccant cooling path 12 and may cool the indoor air flowing into the desiccant cooling path 12, and the main cooler 230 may be mounted at a downstream of the desiccant module 210 in the desiccant cooling path 12, may cool the indoor air dehumidified by passing through the desiccant module 210, and may supply the cooled indoor air to an air-conditioning space (not shown).

In detail, the desiccant cooling system 200 having the structure described above may have a characteristic that a dew-point temperature of the indoor air dehumidified by passing through the side of the desiccant module 210 is lower than a temperature of the main cooler 230. Based on this structure, a dew condensation phenomenon in which water vapor in the indoor air is condensed and forms a droplet may be prevented in the main cooler 230.

The desiccant cooling system 200 according to the embodiment illustrated in FIG. 5 differs from the desiccant cooling system 100 according to the embodiment illustrated in FIG. 1 only in that the desiccant cooling system 200 includes the regeneration path 13 having a structure different from that of the regeneration path 3. Thus, hereinafter, the desiccant module 210, the preliminary cooler 220, and the main cooler 230 mounted in the desiccant cooling path 12 will be understood with reference to the descriptions given above by referring to FIGS. 1 through 4.

Also, a heater 260 mounted in the regeneration path 13 has the same function and purpose as the heater 160 of the desiccant cooling system 100 according to the embodiment illustrated in FIG. 1, and thus, the heater 260 illustrated in FIG. 5 will be understood with reference to the description given above by referring to FIGS. 1 through 4.

In the desiccant cooling system 200 illustrated in FIG. 5 according to an embodiment, outdoor air cannot be introduced into the regeneration path 13, like in the case of an indoor unit of a separate-type air-conditioner. Thus, in the desiccant cooling system 200 according to the embodiment illustrated in FIG. 5, the regeneration path 13 may be formed as a closed circuit, and the desiccant cooling system 200 may further include a cooling desiccant unit 270 mounted at a downstream of the desiccant module 210 and an upstream of the heater 260 in the regeneration path 13, cooling and dehumidifying regeneration air humidified by passing through the desiccant module 210, and supplying the cooled and dehumidified regeneration air to the heater 260. Here, the cooling desiccant unit 270 may share a refrigerant heat source with the main cooler 230.

Unlike the regeneration path 3 illustrated in FIG. 1, the regeneration path 13 of the desiccant cooling system 200 illustrated in FIG. 5 has a closed inner portion. That is, the regeneration path 13 illustrated in FIG. 5 may not include an outdoor air inlet (refer to 7 of FIG. 1) and an outdoor air outlet (refer to 8 of FIG. 1), through which outdoor air flows in and out. Instead, a reference plate 17 forming a circulation path so that the regeneration air sequentially passes through the heater 260, the desiccant module 210, and the cooling desiccant unit 270, and then, flows into the heater 260 again, may be mounted in the regeneration path 13.

According to this structure, condensate water may occur in the cooling desiccant unit 270, and thus, the desiccant cooling system 200 illustrated in FIG. 5 may further include a condensate water storage unit 280 storing the condensate water generated in the cooling desiccant unit 270. The condensate water storage unit 280 may be connected to the outside via an additional discharge pipe (not shown) to discharge the condensate water stored in the condensate water storage unit 280 to the outside. However, fungi may occur in the condensate water storage unit 280.

If the fungi are generated in the condensate water storage unit 280, the fungi and bad smell may be transferred to the desiccant cooling path 12 by the rotation of the desiccant module 210, to be consequently delivered to an indoor environment. Thus, in order to solve this problem, the desiccant module 210 may include an antifungal agent.

Meanwhile, although not illustrated, the desiccant cooling system 200 illustrated in FIG. 5 may further include the condensation sensing sensor 140 and the preliminary cooling air controller 150 as illustrated in FIG. 4. Functions and purposes of the condensation sensing sensor 140 and the preliminary cooling air controller 150 are the same as described above, and thus, their detailed descriptions will not be given, for convenience of explanation.

Figure 6:
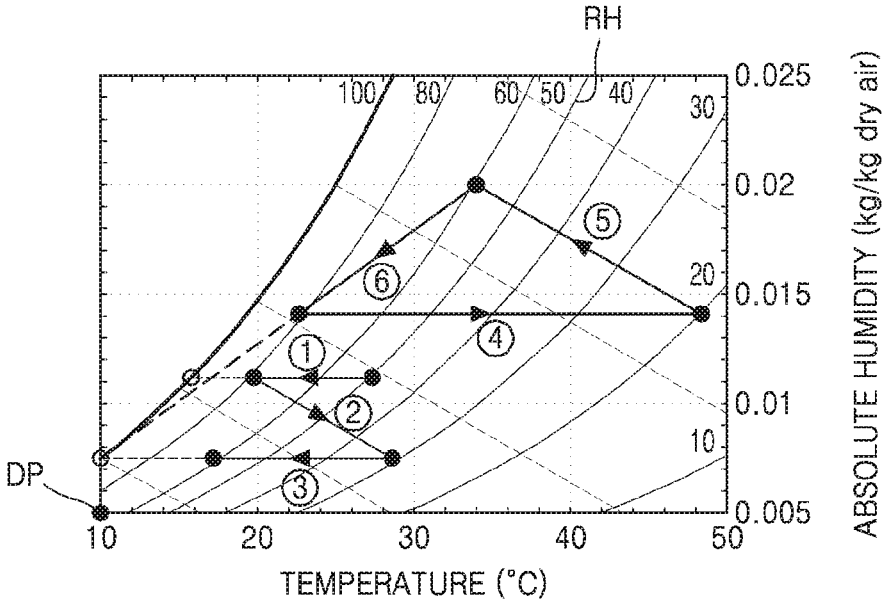
FIG. 6 is a psychrometric chart of indoor air and outdoor air moving through the desiccant cooling system illustrated in FIG. 5.

FIG. 6 is a psychrometric chart of indoor air and outdoor air moving through the desiccant cooling system 200 illustrated in FIG. 5.

Referring to FIGS. 5 and 6, the indoor air having flown into the desiccant cooling path 12 through an indoor air inlet 15 may be cooled (refer to ①) by passing through the preliminary cooler 220. Next, the indoor air cooled by the preliminary cooler 220 may be dehumidified and cooled (refer to ②) by passing through the desiccant module 210. Next, the indoor air dehumidified and cooled by passing through the desiccant module 210 may be cooled (refer to ③) by passing through the main cooler 230 and supplied to an air-conditioning space via an indoor air outlet 16.

That is, the indoor air having flown into the desiccant cooling path 12 may be cooled and dehumidified by sequentially passing through the preliminary cooler 220, the desiccant module 210, and the main cooler 230, and in particular, a dew-point temperature DP of the indoor air having passed through the desiccant module 210 may be about 10 degrees Celsius (a value defined for convenience of explanation), which is a value of an X-axis of the chart illustrated in FIG. 6, at a point in which an absolute humidity (Y-axis) of the indoor air meets a saturation relative humidity chart (in the case of 100 of a RH chart for convenience of explanation).

Here, the dew-point temperature DP (10 degrees Celsius) of the indoor air having passed through the desiccant module 210 may be lower than a temperature of the main cooler 230. This is because the indoor air may be dehumidified by passing through the desiccant module 210 so that an absolute amount of water vapor in the indoor air may be decreased from about 0.011 to about 0.008.

As described above, when the dew-point temperature of the indoor air flowing into the main cooler 230 is lower than the temperature of the main cooler 230, a dew condensation phenomenon in which water vapor in the indoor air is condensed in the main cooler 230 may be prevented. That is, according to the desiccant cooling system 200 according to the embodiment illustrated in FIG. 5, condensate water may not occur in the main cooler 230, and thus, it may be prevented that the condensate water is formed between cooling fins of the main cooler 230 to generate fungi to cause bad smell, or the fungi are introduced to an indoor environment by an air-conditioning operation to contaminate the indoor environment.

Meanwhile, for the desiccant module 210 to continually serve the dehumidification and cooling functions, the desiccant module 210 has to be continually regenerated, except for a portion thereof serving the dehumidification and cooling functions, as described above.

That is, referring to FIGS. 5 and 6, the regeneration air in the regeneration path 13 may be heated (refer to ④) by passing through the heater 260 and the regeneration air heated by the heater 260 may be humidified and cooled (refer to ⑤) by passing through the desiccant module 210. The regeneration air humidified and cooled by passing through the desiccant module 210 may be cooled and dehumidified (refer to ⑥) by passing through the cooling desiccant unit 270 and transferred to the heater 260 again.

As such, the regeneration air moving through the regeneration path 13 of the desiccant cooling system 200 according to the embodiment illustrated in FIG. 5 may continually regenerate the desiccant module 210 passing through the regeneration path 13, by repeatedly going through the operations ④, ⑤, and ⑥.

Figure 7:
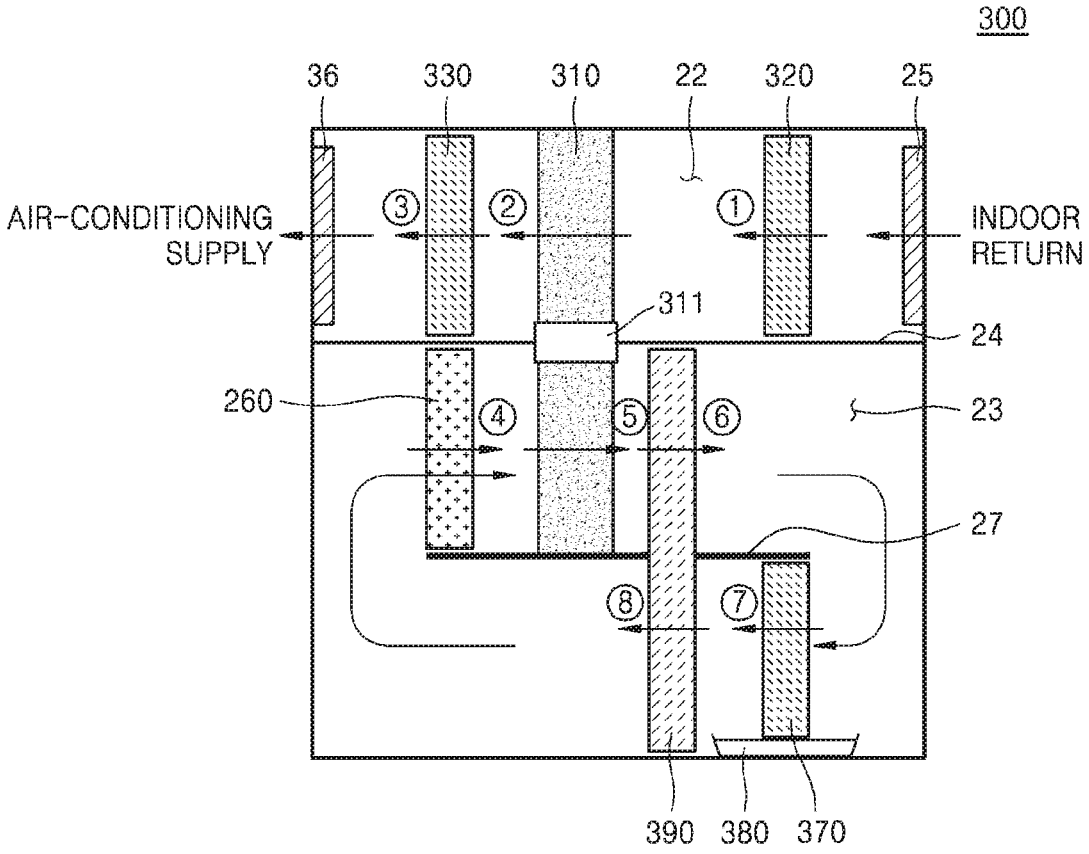
FIG. 7 is a schematic structural diagram of a desiccant cooling system according to another embodiment.

FIG. 7 is a schematic structural diagram of a desiccant cooling system 300 according to another embodiment.

The desiccant cooling system 300 according to the embodiment illustrated in FIG. 7 may have a side mounted in a desiccant cooling path 22 through which indoor air flows and the other side mounted in a regeneration path 23 which is closed and through which regeneration air flows, and may include a desiccant module 310 rotatable around a rotational axis 311, a preliminary cooler 320, and a main cooler 330, wherein the desiccant module 310 may be mounted to be rotatable at a division plate 24 dividing the desiccant cooling path 22 and the regeneration path 23, the preliminary cooler 320 may be mounted at an upstream of the desiccant module 310 in the desiccant cooling path 22 and may cool the indoor air flowing into the desiccant cooling path 22, and the main cooler 330 may be mounted at a downstream of the desiccant module 310 in the desiccant cooling path 22 and may cool the indoor air dehumidified by passing through the desiccant module 310 and supply the cooled indoor air to an air-conditioning space (not shown).

In detail, the desiccant cooling system 300 having the structure described above may have a characteristic that a dew-point temperature of the indoor air dehumidified by passing through the side of the desiccant module 310 is lower than a temperature of the main cooler 330. Based on this structure, a dew condensation phenomenon in which water vapor in the indoor air is condensed and forms a droplet may be prevented in the main cooler 330.

A reference plate 27 forming a circulation path so that the regeneration air sequentially passes through a heater 360, the desiccant module 310, and a cooling desiccant unit 370, and then, flows into the heater 360 again, may be mounted in the regeneration path 23. Also, a heat recovery heat exchanger 390 having a side cooling the regeneration air humidified by passing through the desiccant module 310 and the other side heating the regeneration air cooled and dehumidified by passing through the cooling desiccant unit 370 may be mounted. The heat recovery heat exchanger 390 may include a plate-type heat exchanger or a rotation-type heat exchanger.

When the heat recovery heat exchanger 390 is a rotation-type heat exchanger and the heat recovery heat exchanger 390 rotates based on the reference plate 27, the heat recovery heat exchanger 390 may cool the regeneration air while the regeneration air passes through a portion of the heat recovery heat exchanger 390, the portion being adjacent to a downstream of the desiccant module 310, and the heat recovery heat exchanger 390 may heat the regeneration air while the regeneration air passes through the other portion of the heat recovery heat exchanger 390, the other portion being adjacent to a downstream of the cooling desiccant unit 370.

The desiccant cooling system 300 according to the embodiment illustrated in FIG. 7 differs from the desiccant cooling system 200 according to the embodiment illustrated in FIG. 5 only in that the desiccant cooling system 300 includes the heat recovery heat exchanger 390 in the regeneration path 23. Thus, hereinafter, the desiccant module 310, the preliminary cooler 320, and the main cooler 330 mounted in the desiccant cooling path 22 will be understood with reference to the descriptions given above by referring to FIGS. 1 through 6.

Also, the heater 360 mounted in the regeneration path 23 has the same function and purpose as the heaters 160 and 260 of the desiccant cooling systems 100 and 200 according to the embodiments illustrated in FIGS. 1 and 5, respectively, and thus, the heater 360 illustrated in FIG. 7 will be understood with reference to the description given above by referring to FIGS. 1 through 6.

Meanwhile, although not illustrated, the desiccant cooling system 300 illustrated in FIG. 7 may further include a condensation sensing sensor 140 and a preliminary cooling air controller 150, as illustrated in FIG. 4. Functions and purposes of the condensation sensing sensor 140 and the preliminary cooling air controller 150 are the same as described above, and thus, their detailed descriptions will not be given, for convenience of explanation.

Figure 8:
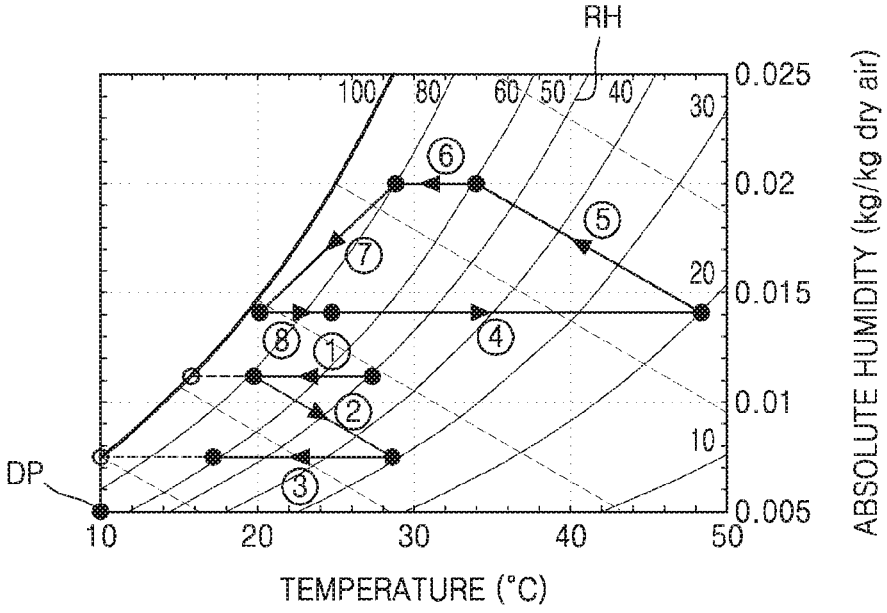
FIG. 8 is a psychrometric chart of indoor air and outdoor air moving through the desiccant cooling system illustrated in FIG. 7.

FIG. 8 is a psychrometric chart of indoor air and outdoor air moving through the desiccant cooling system 300 illustrated in FIG. 7.

Referring to FIGS. 7 and 8, the indoor air having flown into the desiccant cooling path 22 through an indoor air inlet 25 may be cooled (refer to ①) by passing through the preliminary cooler 320. Next, the indoor air cooled by the preliminary cooler 320 may be dehumidified and cooled (refer to ②) by passing through the desiccant module 310. Next, the indoor air dehumidified and cooled by passing through the desiccant module 310 may be cooled (refer to ③) by passing through the main cooler 330 and supplied to an air-conditioning space via an indoor air outlet 26.

That is, the indoor air having flown into the desiccant cooling path 22 may sequentially pass through the preliminary cooler 320, the desiccant module 310, and the main cooler 330 to be cooled and dehumidified, and in particular, a dew-point temperature DP of the indoor air having passed through the desiccant module 310 may be about 10 degrees Celsius (a value defined for convenience of explanation), which is a value of an X-axis of the chart illustrated in FIG. 8, at a point in which an absolute humidity (Y-axis) of the indoor air meets a saturation relative humidity chart (in the case of 100 of a RH chart for convenience of explanation).

Here, the dew-point temperature DP (10 degrees Celsius) of the indoor air having passed through the desiccant module 310 may be lower than a temperature of the main cooler 330. This is because the indoor air may be dehumidified by passing through the desiccant module 310 so that an absolute amount of water vapor in the indoor air may be decreased from about 0.011 to about 0.008.

As described above, when the dew-point temperature of the indoor air flowing into the main cooler 330 is lower than the temperature of the main cooler 330, a dew condensation phenomenon in which water vapor in the indoor air is condensed in the main cooler 330 may be prevented. That is, according to the desiccant cooling system 300 according to the embodiment illustrated in FIG. 7, condensate water may not occur in the main cooler 330, and thus, it may be prevented that the condensate water is formed between cooling fins of the main cooler 330 to generate fungi to cause bad smell, or the fungi are introduced to an indoor environment by an air-conditioning operation to contaminate the indoor environment.

Meanwhile, for the desiccant module 310 to continually serve the dehumidification and cooling functions, the desiccant module 310 has to be continually regenerated, except for a portion thereof serving the dehumidification and cooling functions, as described above.

That is, referring to FIGS. 7 and 8, the regeneration air in the regeneration path 23 may be heated (refer to ④) by passing through the heater 360 and the regeneration air heated by the heater 360 may be humidified and cooled (refer to ⑤) by passing through the desiccant module 310. The regeneration air humidified and cooled by passing through the desiccant module 310 may be cooled (refer to ⑥) by passing through the heat recovery heat exchanger 390, and the regeneration air cooled by passing through the heat recovery heat exchanger 390 may be cooled and dehumidified (refer to ⑦) by passing through the cooling desiccant unit 370. Also, the regeneration air cooled and dehumidified by passing through the cooling desiccant unit 370 may be transferred again to the heater 360 (refer to ⑧).

As such, the regeneration air flowing through the regeneration path 23 of the desiccant cooling system 300 according to the embodiment illustrated in FIG. 7 may continually regenerate the desiccant module 310 passing through the regeneration path 23, by repeatedly going through the operations ④, ⑤, ⑥, ⑦, and ⑧.

Thus, according to the desiccant cooling system 300 illustrated in FIG. 7, as the desiccant cooling system 300 further includes the heat recovery heat exchanger 390 in the regeneration path 23, the amount of refrigerant heat for condensing and removing water may be reduced.

As described above, according to the one or more of the above embodiments, the desiccant cooling system may maintain the dew-point temperature of the indoor air to be lower than the temperatures of the preliminary cooler and the main cooler, so as to prevent the occurrence of condensate water.

Also, since the condensate water does not occur, propagation of bacteria, virus, and fungi may be suppressed, and introduction of the same into an indoor environment to contaminate the indoor environment during an air-conditioning operation may be prevented.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A desiccant cooling system for preventing condensate water in a desiccant cooling path, comprising:

a desiccant module mounted in a division plate to be rotatable and having a side mounted in the desiccant cooling path, through which a stream of air moves, and another side mounted in a regeneration path through which another stream of air moves, wherein the division plate defines the desiccant cooling path and the regeneration path;

a preliminary cooler mounted upstream of the desiccant module in the desiccant cooling path and configured to cool the stream of air flowing into the desiccant cooling path; and a main cooler mounted downstream of the desiccant module in the desiccant cooling path and configured to cool the stream of air dehumidified by passing through the desiccant module and supply the cooled stream of air to an air-conditioning space, wherein a dew-point temperature of the stream of air dehumidified by passing through the side of the desiccant module is less than a temperature of the main cooler so that a dew condensation phenomenon in which water vapor in the air is condensed and forms a droplet is prevented in the main cooler, and wherein the desiccant cooling system further comprises:

a condensation sensing sensor mounted in the preliminary cooler and configured to sense whether or not the stream of air is condensed and condensate water is generated in the preliminary cooler, and a preliminary cooling temperature controller configured to control a temperature of the preliminary cooler such that the temperature of the preliminary cooler is maintained to be higher than the dew-point temperature of the stream of air flowing into the desiccant cooling path, based on a signal of the condensation sensing sensor, wherein the preliminary cooling temperature controller is configured to, in response to the signal, reduce a flow amount of a refrigerant flowing into the preliminary cooler in order to increase the temperature of the preliminary cooler.

2. The desiccant cooling system of claim 1, further comprising:

a heater mounted upstream of the desiccant module in the regeneration path and configured to heat another stream of air flowing into the regeneration path.

3. The desiccant cooling system of claim 1, wherein, as the desiccant module rotates with respect to the division plate, the desiccant module is configured to dehumidify the stream of air so as to adsorb water vapors from the stream of air while a portion of the desiccant module is passing through the desiccant cooling path, and the desiccant module is further configured to regenerate via another stream of air and discharge the water vapors to another stream of air while the portion of the desiccant module is passing through the regeneration path.

* * * * *